US012320621B1

(12) United States Patent
Guzman

(10) Patent No.: US 12,320,621 B1
(45) Date of Patent: Jun. 3, 2025

(54) BULLETPROOF SHIELDING DEVICES AND METHODS

(71) Applicant: John Guzman, Houston, TX (US)

(72) Inventor: John Guzman, Houston, TX (US)

( * ) Notice: Subject to any disclaimer, the term of this patent is extended or adjusted under 35 U.S.C. 154(b) by 54 days.

(21) Appl. No.: 18/529,871

(22) Filed: Dec. 5, 2023

(51) Int. Cl.
*F41H 5/08* (2006.01)
*F41H 5/013* (2006.01)
*F41H 5/04* (2006.01)

(52) U.S. Cl.
CPC ..... *F41H 5/08* (2013.01); *F41H 5/013* (2013.01); *F41H 5/0478* (2013.01)

(58) Field of Classification Search
CPC ..... F41H 5/0478; F41H 5/08; F41H 5/013
See application file for complete search history.

(56) References Cited

U.S. PATENT DOCUMENTS 4,674,394 A * 6/1987 Martino ..... F41H 5/08 2/2.5
5,179,244 A * 1/1993 Zufle ..... B32B 27/12 428/113
5,641,934 A 6/1997 Follett
6,389,949 B1 * 5/2002 Carreira ..... F41H 5/08 2/2.5
6,642,159 B1 * 11/2003 Bhatnagar ..... F41H 5/0478 428/113
7,712,408 B1 5/2010 Copeland
7,825,048 B2 * 11/2010 Wang ..... A43B 13/12 2/2.5
7,958,812 B2 * 6/2011 Wang ..... F41H 5/0471 89/922
7,971,516 B2 7/2011 Hogan
7,976,932 B1 * 7/2011 Lyons ..... B32B 5/024 156/304.6
8,375,839 B2 * 2/2013 Landi ..... F41H 5/0471 89/36.02
8,584,571 B2 * 11/2013 Armellino, Jr. ..... F41H 5/08 89/36.01
8,646,371 B2 * 2/2014 Fisher ..... F41H 5/0414 89/906
D748,336 S 1/2016 Battaglieri
9,261,334 B1 * 2/2016 Saint ..... B32B 5/024
10,234,245 B2 3/2019 Mickiewicz
(Continued)

FOREIGN PATENT DOCUMENTS

GB 2471660 12/2011

*Primary Examiner* — Joshua E Freeman

(57) ABSTRACT

A bulletproof shielding devices and methods for protecting a user from high velocity projectiles such as bullets includes a panel having a front side and a back side. The front side is a raw carbon fiber material bonded with an epoxy resin. The back side is an extended chain polyethylene fiber material blended with the raw carbon fiber material. A bullet resistant material is positioned between the front side and the back side. The bullet resistant material includes at least four layers of an ultra-high-molecular-weight-polyethylene material. The extended chain polyethylene fiber material entangles a projectile being shot at the front side, reducing a force of an impact of the projectile and facilitating the bullet resistant material in stopping the projectile. The raw carbon fiber material exerts a force toward the projectile thereby inhibiting the progression of the projectile. The panel has a weight between 4.5 pounds and 7.5 pounds.

15 Claims, 8 Drawing Sheets

(56) References Cited

U.S. PATENT DOCUMENTS

| | | | | |
|---|---|---|---|---|
| 10,655,940 | B2 * | 5/2020 | Li | F41H 5/0485 |
| 11,473,876 | B2 * | 10/2022 | Landtiser | A45C 13/103 |
| 2012/0174748 | A1 * | 7/2012 | Landi | F41H 5/0478 89/922 |
| 2013/0220106 | A1 * | 8/2013 | Van Elburg | F41H 5/0485 29/402.09 |
| 2015/0308791 | A1 * | 10/2015 | Navarra | F41H 5/0478 89/36.02 |
| 2018/0017359 | A1 * | 1/2018 | Li | B32B 25/14 |

* cited by examiner

BULLETPROOF SHIELDING DEVICES AND METHODS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bulletproof shields and more particularly pertains to a new bulletproof shield for protecting a user from high velocity projectiles such as bullets.

(2) Description of Related Art Including Information Disclosed Under 37 CFR 1.97 and 1.98

The prior art relates to bulletproof shields. Bulletproof shields are vital tools for saving lives and preventing injury. The shields may be used anywhere that a ballistic threat is possible. As violence and crime rates continue to rise, the importance of having protective equipment such as bulletproof shields becomes even greater. The shields are typically large and heavy, weighing 60.0 pounds or more. The shields are therefore very impractical for the general public to carry. The size of typical bulletproof shields also makes them difficult to transport, store, and use. Thus, there is a need in the art for a portable bulletproof shield that can offer protection and that is lightweight and easily transportable so that the shield is available whenever it is needed.

BRIEF SUMMARY OF THE INVENTION

An embodiment of the disclosure meets the needs presented above by generally comprising a panel having a front side and a back side. The front side comprises a raw carbon fiber material being bonded with an epoxy resin. The back side comprises an extended chain polyethylene fiber material being blended with the raw carbon fiber material. A bullet resistant material is coupled to and positioned between the front side and the back side. The bullet resistant material comprises at least four layers of an ultra-high-molecular-weight-polyethylene material. The extended chain polyethylene fiber material is configured to entangle a projectile being shot at the front side of the panel thereby reducing a force of an impact of the projectile and facilitating the bullet resistant material in stopping a progression of the projectile through the panel. The raw carbon fiber material is configured to exert a force toward the projectile thereby inhibiting the progression of the projectile through the panel. The panel has a weight between 4.5 pounds and 7.5 pounds.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
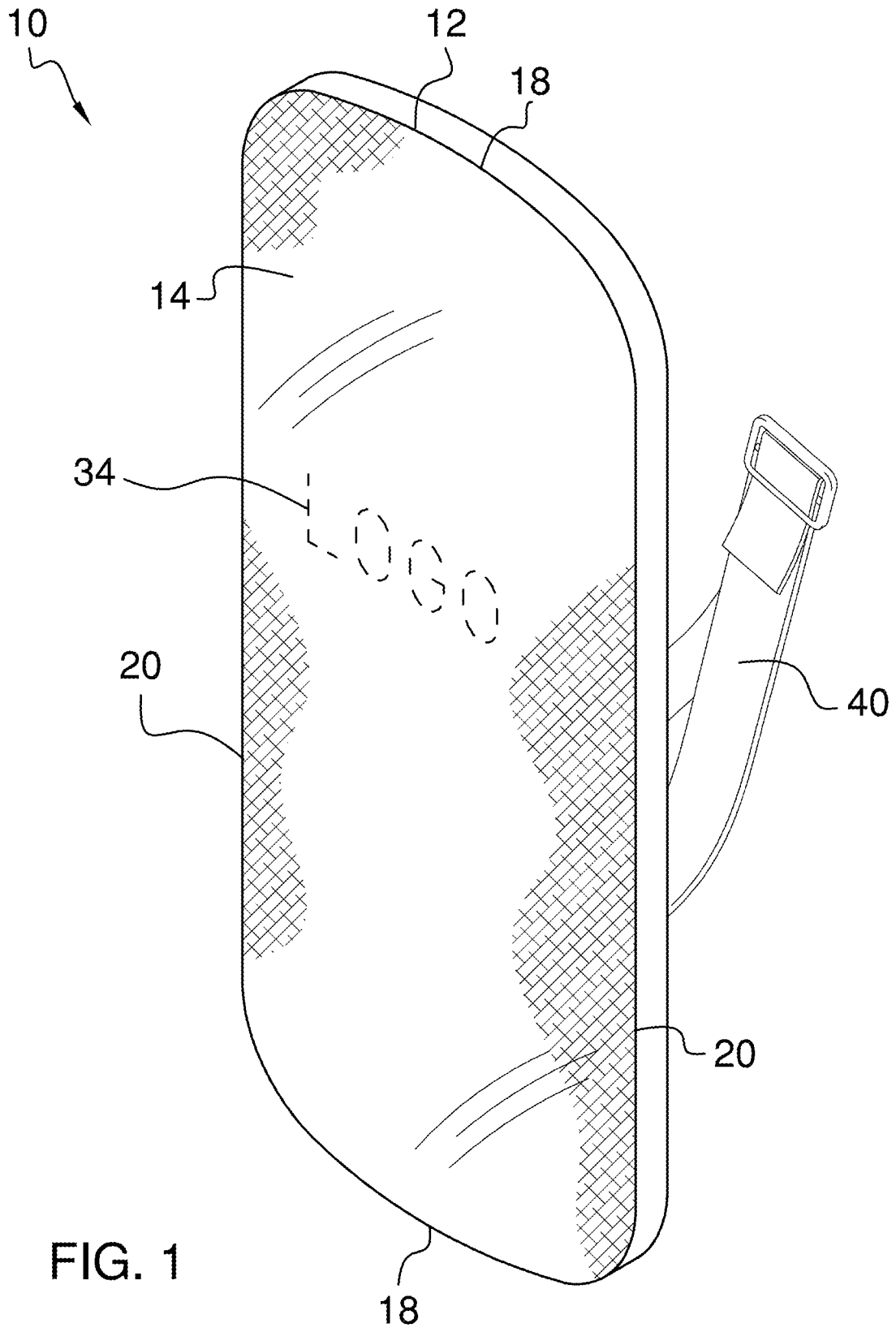
FIG. 1 is an isometric view of a bulletproof shielding devices and methods according to an embodiment of the disclosure.
Figure 2:
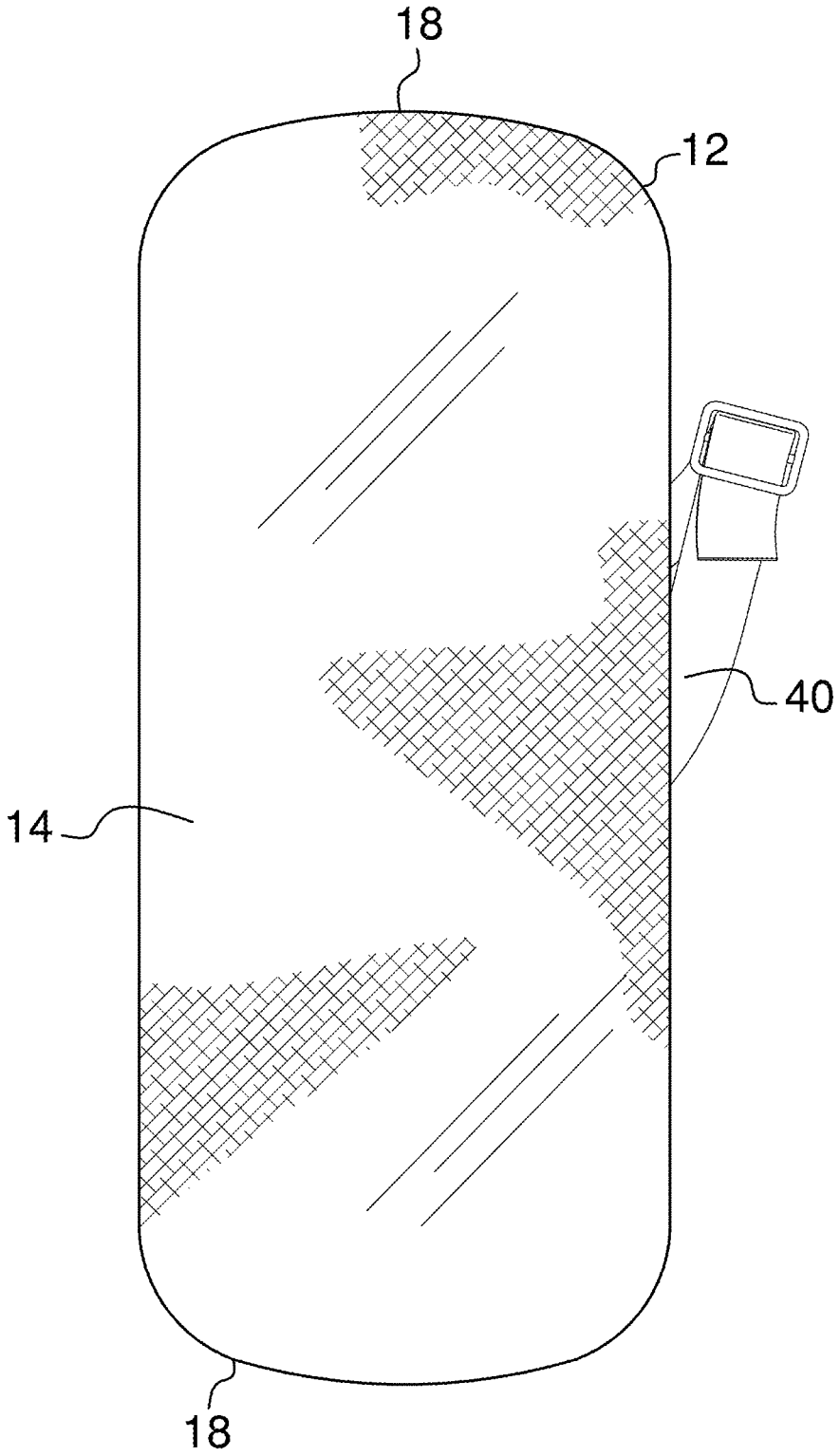
FIG. 2 is a front view of an embodiment of the disclosure.
Figure 3:
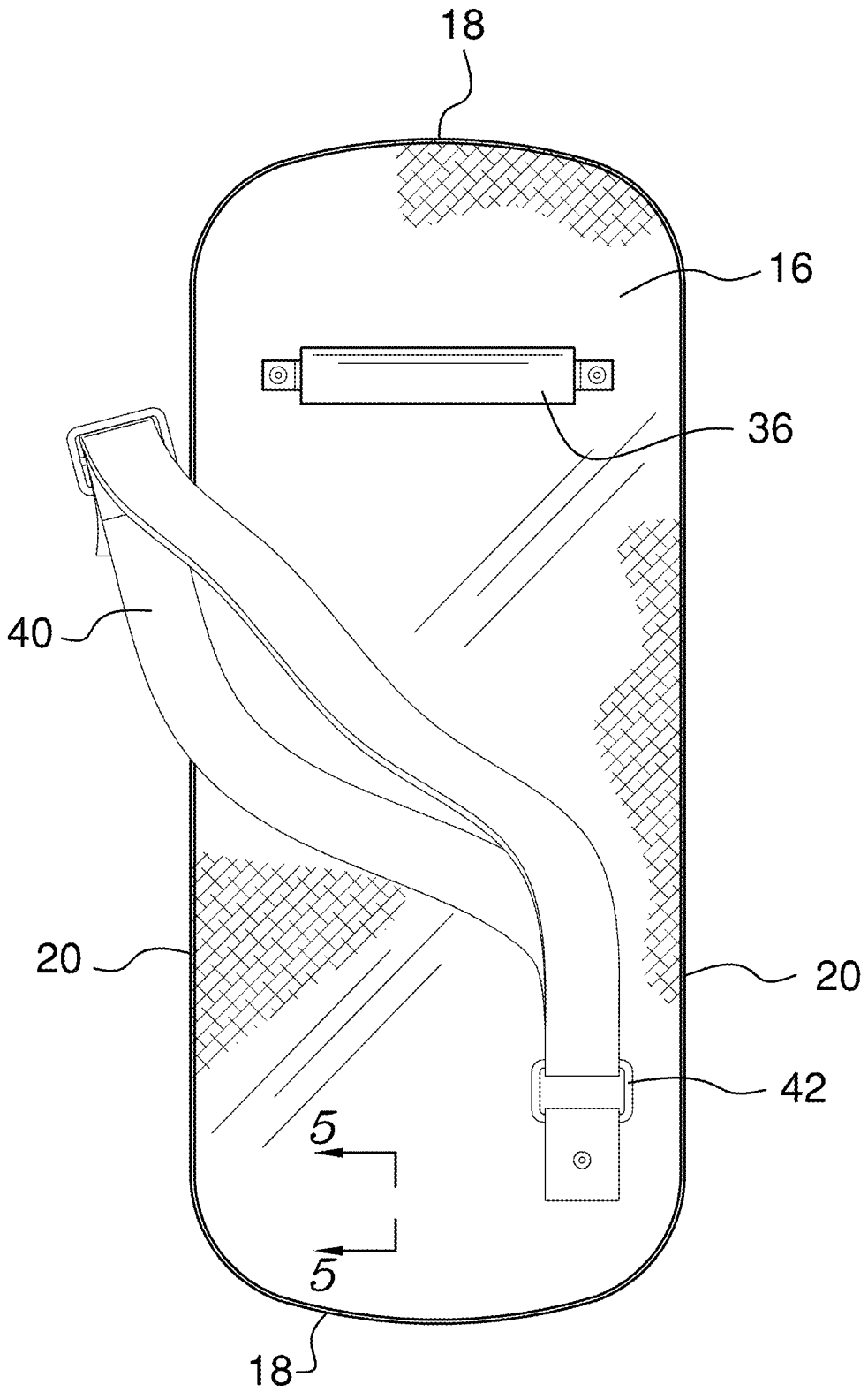
FIG. 3 is a back view of an embodiment of the disclosure.
Figure 4:
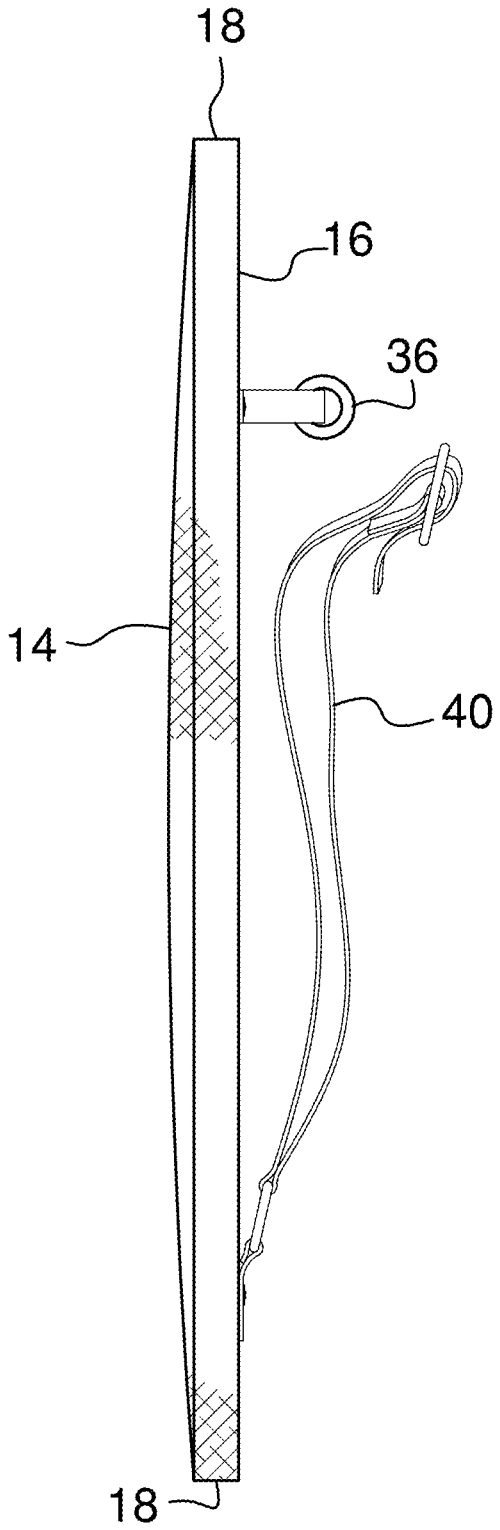
FIG. 4 is a side view of an embodiment of the disclosure.
Figure 5:
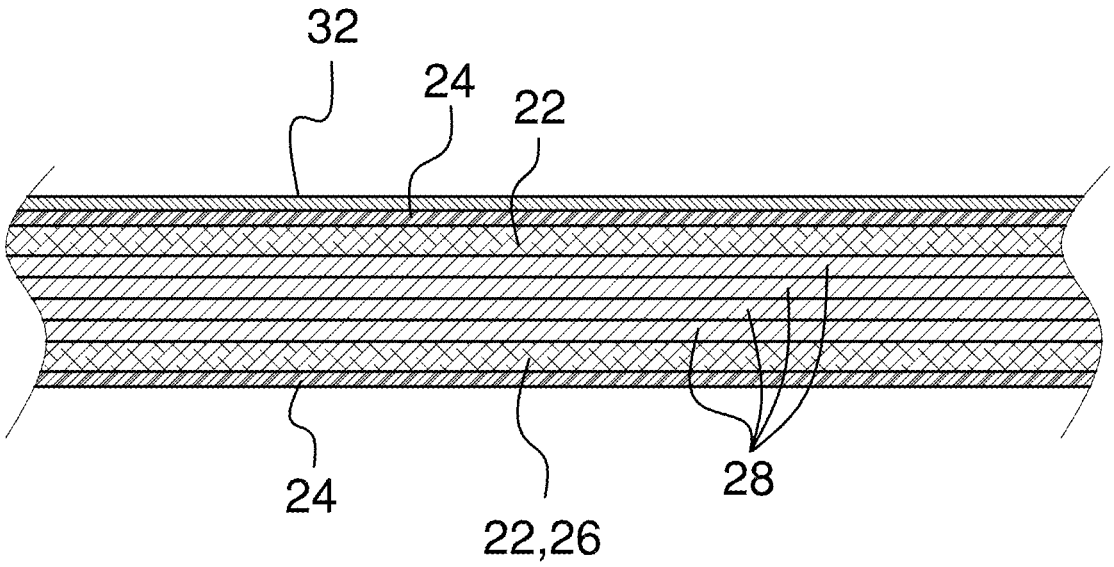
FIG. 5 is a cross-sectional view of an embodiment of the disclosure.
Figure 6:
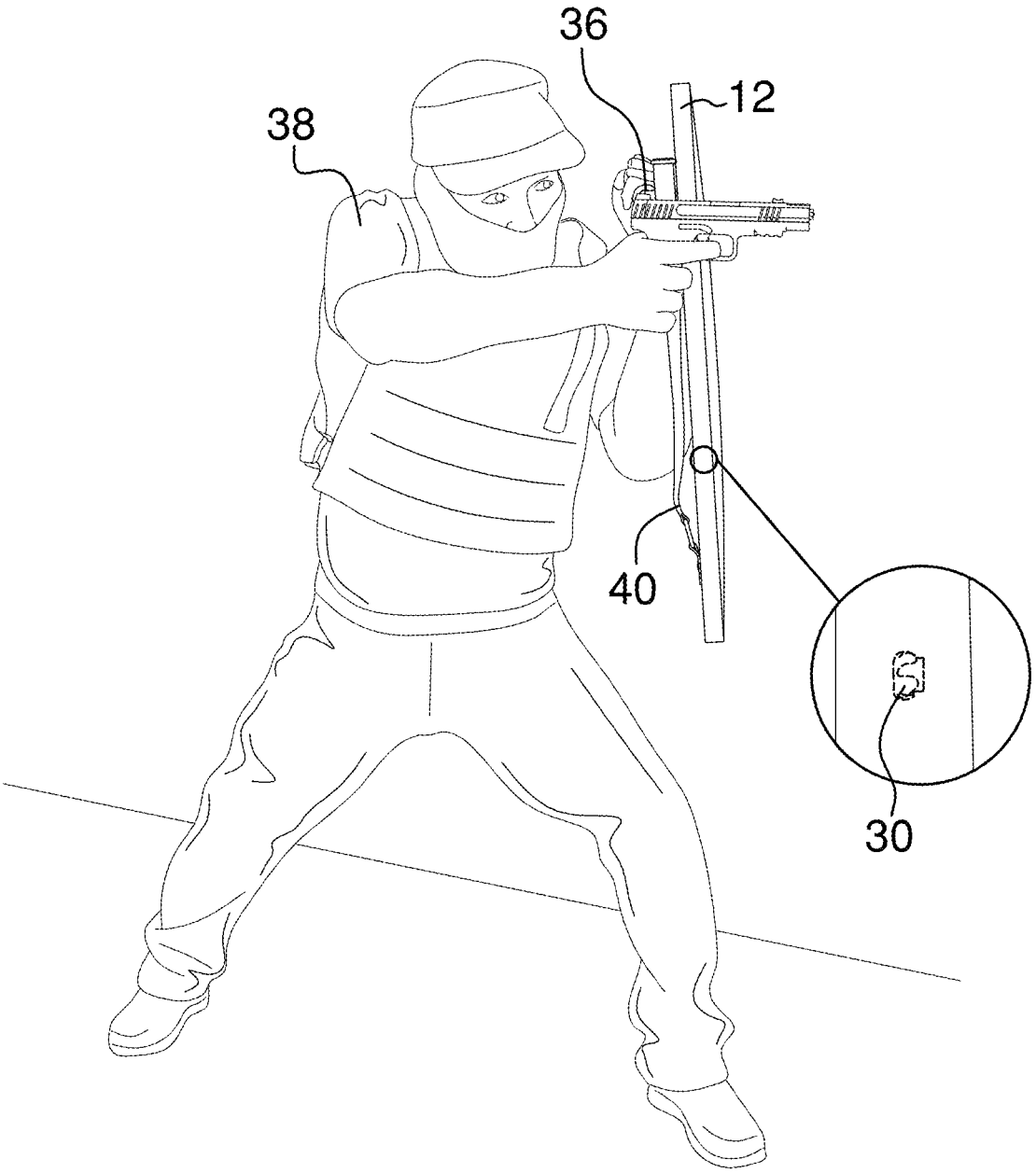
FIG. 6 is an in-use view of an embodiment of the disclosure.
Figure 7:
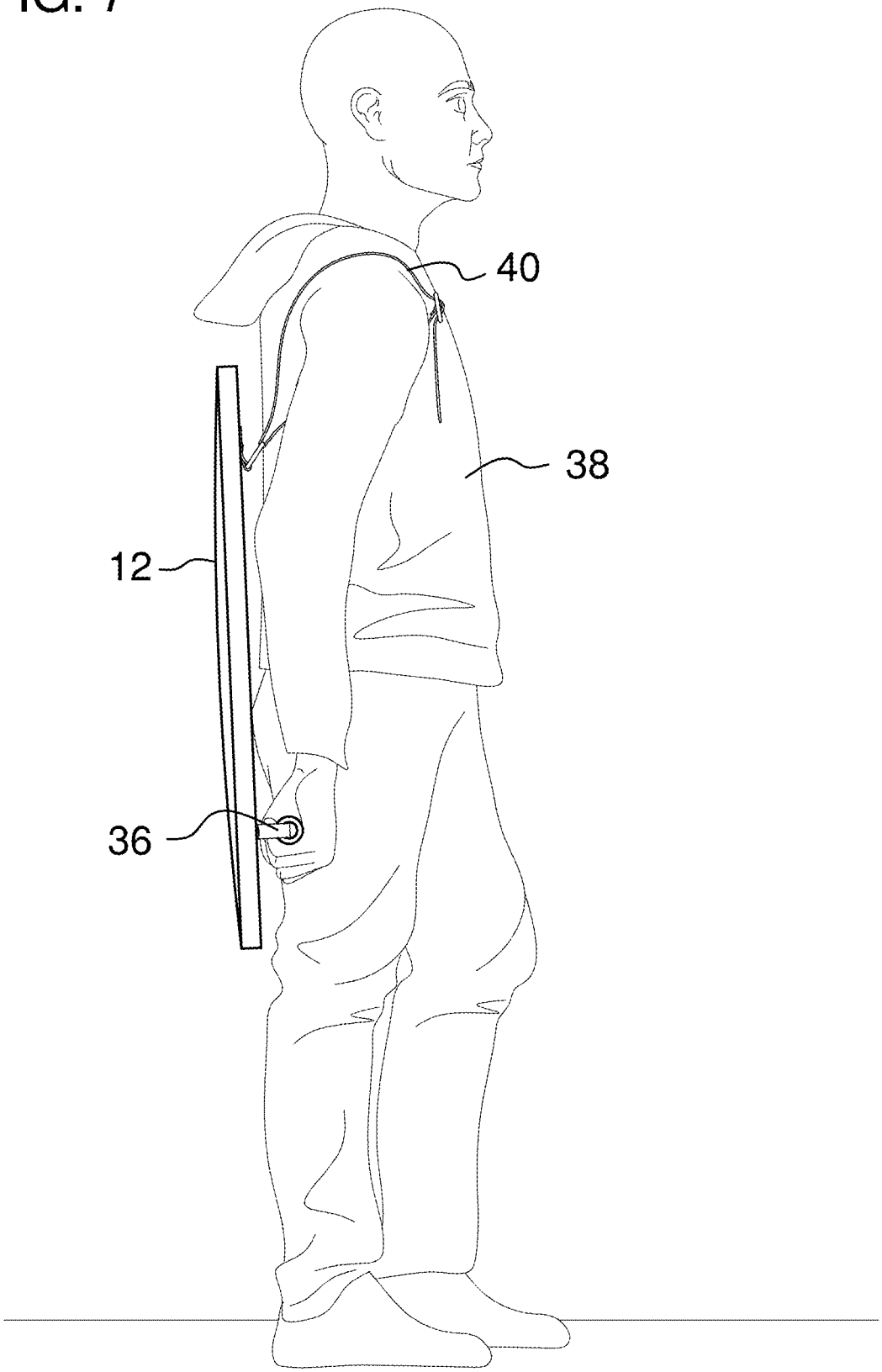
FIG. 7 is an in-use view of an embodiment of the disclosure.

With reference now to the drawings, and in particular to FIGS. 1 through 8 thereof, a new bulletproof shield embodying the principles and concepts of an embodiment of the disclosure and generally designated by the reference numeral 10 will be described.

As best illustrated in FIGS. 1 through 8, the bulletproof shielding devices and methods 10 generally comprises a panel 12 that has a front side 14 and a back side 16. The panel 12 has a first pair of lateral edges 18 and a second pair of lateral edges 20. The second pair of lateral edges 20 is attached to and extends between the first pair of lateral edges 18. Each of the second pair of lateral edges 20 may have a length exceeding a length of the first pair of lateral edges 18. For example, each of the first pair of lateral edges 18 may have a length between 15.0 inches and 17.0 inches and each of the second pair of lateral edges 20 may have a length between 19.0 inches and 21.0 inches.

The front side 14 may be convexly arcuate between a first one of the first pair of lateral edges 18 and a second one of the first pair of lateral edges 18.

The front side 14 generally comprises a raw carbon fiber material 22 that is bonded with an epoxy resin 24. The back side 16 generally comprises an extended chain polyethylene fiber material 26 that is blended with the raw carbon fiber material 22 and the epoxy resin 24. The raw carbon fiber material 22 generally bonds with the epoxy resin 24, although the extended chain polyethylene fiber material 26 may not. For example, the extended chain polyethylene fiber material may comprise SPECTRA S-1000 fiber material and the epoxy resin may comprise a (907) epoxy resin.

A bullet resistant material 28 is coupled to and positioned between the front side 14 and the back side 16. The bullet resistant material 28 generally comprises at least four layers of an ultra-high-molecular-weight-polyethylene material. The at least four layers of the ultra-high-molecular-weight-polyethylene material may alternate between a heat pressed sheet and a loose sheet of the ultra-high-molecular-weight-polyethylene material. For example, the ultra-high-molecular-weight-polyethylene material may comprise CUBEN FIBER, which is also known as DYNEEMA COMPOSITE FABRIC.

The extended chain polyethylene fiber material 26 is configured to entangle a projectile 30 that is shot at the front side 14 of the panel 12 thereby reducing a force of an impact of the projectile 30 and facilitating the bullet resistant material 28 in stopping a progression of the projectile 30 through the panel 12. For example, the extended chain polyethylene fiber material 26 may be flexible enough to entangle the projectile 30 as the projectile 30 moves through the extended chain polyethylene fiber material 26.

The raw carbon fiber material 22 is configured to exert a force toward the projectile 30 thereby inhibiting the progression of the projectile 30 through the panel 12. For example, the raw carbon fiber material 22 may be rigid enough to exert the force toward the projectile 30 and inhibit the progression of the projectile 30 through the panel 12. The blended material of the back side 16, which comprises the extended chain polyethylene fiber material 26 with the raw carbon fiber material 30 that is bonded to the epoxy resin 24, creates a backwards pressure against the projectile 30 as the projectile 30 moves through the panel 12. This backwards pressure slows the progression of the projectile 30 through the panel 12 and helps the layers of the bullet proof material 28 to stop the projectile 30.

A vinyl coating 32 may be positioned on the front side 14. The vinyl coating 32 may also be wrapped around the entire panel 12, covering at least a portion of both the front side 14 and the back side 16. A decorative indicia being printed on the vinyl coating 32. The decorative indicia may alternatively be positioned directly on the panel 12, for example if the panel 12 is not wrapped in the vinyl coating 32.

A handle 36 is coupled to the back side 16. The handle 36 is generally aligned with the first pair of lateral edges 18. For example, the handle 36 may be positioned proximate to the first one of the first pair of lateral edges 18. The handle 36 is generally configured for being gripped by a user 38.

A strap 40 is coupled to the back side 16. The strap 40 may have an extendable length. The strap 40 is generally configured to receive a shoulder of the user 38 thereby facilitating the user 38 in carrying the panel 12 over the shoulder. A fastener 42 may be mounted to the back side 16 for coupling the strap 40 to the back side 16. The fastener 42 is generally spaced from the handle 36. For example, the fastener 42 may be positioned proximate to the second one of the first pair of lateral edges 18 whereby the fastener 42 and the strap 40 are configured to facilitate the user 38 in gripping the handle 36 while the user 38 is carrying the panel 12 over the shoulder.

In use, the panel 12 is configured for easy and convenient transport by a user 32. Accordingly, the panel 12 may have a weight between 4.5 pounds and 7.5 pounds. The user 38 may carry the panel 12 over their shoulder with the strap 40. While the panel 12 is positioned across the back of the user 38, the user 38 can grip the handle 36 to facilitate manipulation of the panel 12 around the body of the user 38 to protect the front of the user 38. An example of such embodiments is provided in FIGS. 6 and 7.

Figure 8:
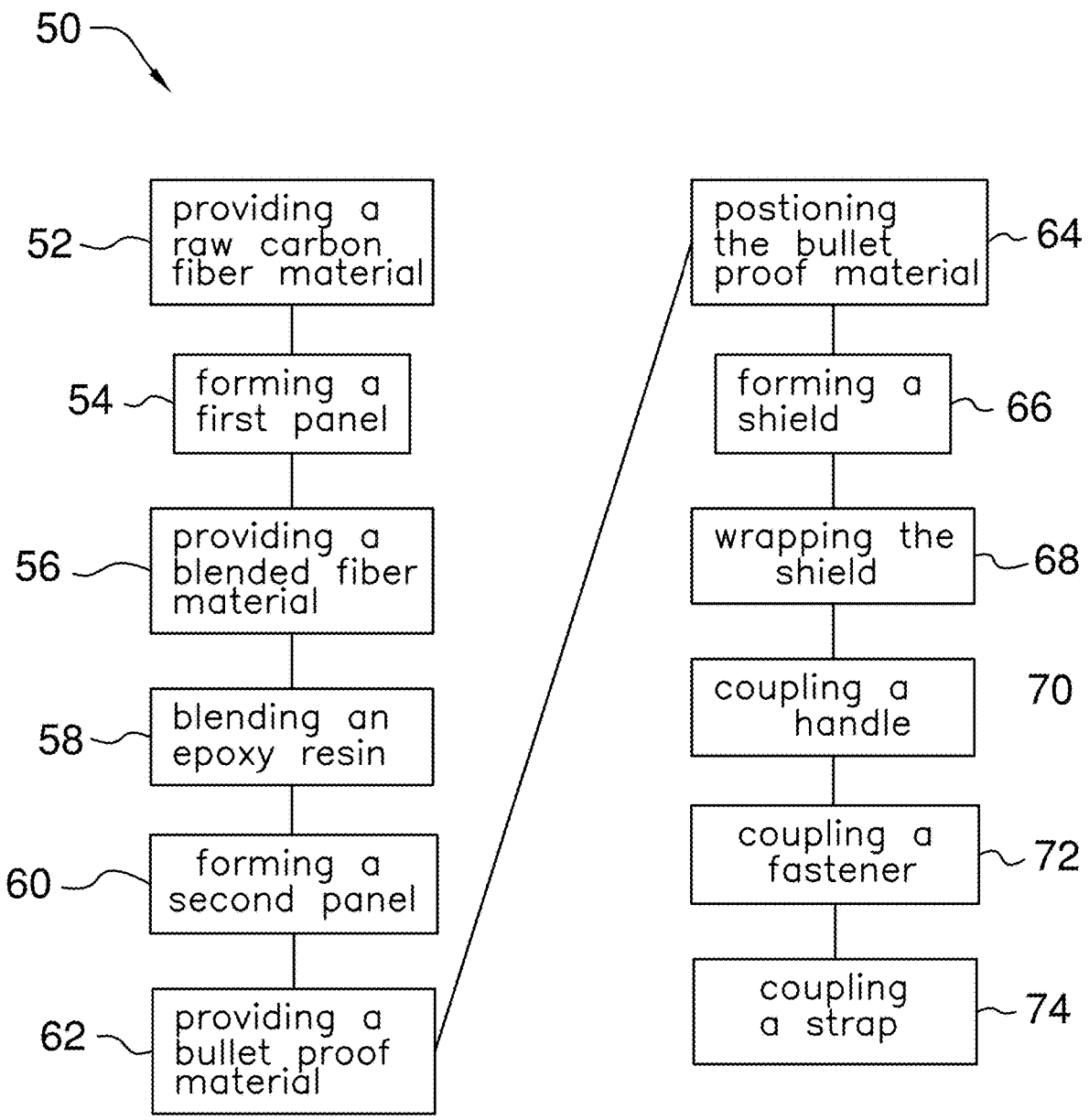
FIG. 8 is a block diagram view of an embodiment of the disclosure.

As shown in FIG. 8, the present disclosure further provides a method 50 of manufacturing a shield. The method 50 comprises a step 52 of providing a raw carbon fiber material. The method 50 further comprises a step 54 of using the raw carbon fiber material to form a first panel. The method 50 further includes a step 56 of providing a blended fiber material comprising an extended chain polyethylene fiber material and the raw carbon fiber material. The method 50 further includes a step 58 of bonding an epoxy resin to the blended fiber material to form a bonded fiber material. The epoxy resin bonds with the raw carbon fiber material within the blended fiber material.

The method 50 further includes the step 60 of using the bonded fiber material to form a second panel. The second panel has a shape that is complementary to a shape of the first panel. The method 50 further includes a step 62 of providing at least four sheets of a bullet proof material. Each of the at least four sheets of the bullet proof material generally have a shape that is complementary to a shape of the first panel and the second panel. The bullet proof material may comprise an ultra-high-molecular-weight-polyethylene material.

The method 50 includes a step 64 of positioning the at least four sheets of the bullet proof material between the first panel and the second panel and a step 66 of coupling the first panel, the at least four sheets of the bullet proof material, and the second panel together to form a shield. The shield generally has a weight between 4.5 pounds and 7.5 pounds. The first panel generally comprises a front side of the shield and the second panel generally comprises a back side of the shield. The shield may include a first pair of lateral edges and a second pair of lateral edges. The second pair of lateral edges is attached to and extends between the first pair of lateral edges. Each of second pair of lateral edges may have a length exceeding a length of the first pair of lateral edges.

The method 50 may further include a step 68 of wrapping the shield in a vinyl material and a step of printing a decorative indicia on the vinyl material.

The method 50 also includes a step 70 of coupling a handle to the back side of the shield. The handle is generally aligned with the first pair of lateral edges. For example, the handle may be positioned proximate to a first one of the first pair of lateral edges. The handle is configured for being gripped by a user.

The method 50 also includes a step 72 of coupling a fastener to the back side of the shield. The fastener is generally spaced from the handle. For example, the fastener may be positioned proximate to a second one of the first pair of lateral edges. The method 50 also includes a step 74 of coupling a strap to the fastener on the back side of the shield. The strap is spaced from the handle wherein the handle is configured for gripping by a user while the strap is positioned around a shoulder of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bulletproof shield assembly comprising:

a panel having a front side and a back side;

the front side comprising a raw carbon fiber material being bonded with an epoxy resin;

the back side comprising an extended chain polyethylene fiber material being blended with the raw carbon fiber material;

a bullet resistant material being coupled to and positioned between the front side and the back side, the bullet resistant material comprising at least four layers of an ultra-high-molecular-weight-polyethylene material;

wherein the extended chain polyethylene fiber material is configured to entangle a projectile being shot at the front side of the panel thereby reducing a force of an impact of the projectile and facilitating the bullet resistant material in stopping a progression of the projectile through the panel;

wherein the raw carbon fiber material is configured to exert a force toward the projectile thereby inhibiting the progression of the projectile through the panel; and wherein the panel has a weight between 4.5 pounds and 7.5 pounds.

2. The bulletproof shield assembly of claim 1, the panel further comprising a first pair of lateral edges and a second pair of lateral edges, the second pair of lateral edges being attached to and extending between the first pair of lateral edges.

3. The bulletproof shield assembly of claim 2, wherein each of the second pair of lateral edges has a length exceeding a length of the first pair of lateral edges.

4. The bulletproof shield assembly of claim 2, wherein each of the first pair of lateral edges has a length between 15.0 inches and 17.0 inches, and wherein each of the second pair of lateral edges has a length between 19.0 inches and 21.0 inches.

5. The bulletproof shield assembly of claim 2, wherein the front side is convexly arcuate between a first one of the first pair of lateral edges and a second one of the first pair of lateral edges.

6. The bulletproof shield assembly of claim 2, further comprising a handle being coupled to the back side, the handle being aligned with the first pair of lateral edges, the handle being positioned proximate to a first one of the first pair of lateral edges.

7. The bulletproof shield assembly of claim 6, further comprising:

a strap being coupled to the back side, the strap having an extendable length, the strap being configured to receive a shoulder of the user thereby facilitating the user in carrying the panel over the shoulder; and a fastener being mounted to the back side for coupling the strap to the back side, the fastener being spaced from the handle, the fastener being positioned proximate to the second one of the first pair of lateral edges thereby being configured to facilitate the user in gripping the handle while the user is carrying the panel over the shoulder.

8. The bulletproof shield assembly of claim 1, further comprising a vinyl coating being positioned on the front side.

9. The bulletproof shield assembly of claim 1, further comprising a decorative indicia being positioned on the panel.

10. The bulletproof shield assembly of claim 1, further comprising a handle being coupled to the back side.

11. The bulletproof shield assembly of claim 1, further comprising a strap being coupled to the back side, the strap being configured to receive a shoulder of the user thereby facilitating the user in carrying the panel over the shoulder.

12. The bulletproof shield assembly of claim 11, wherein the strap has an extendable length.

13. The bulletproof shield assembly of claim 11, further comprising a fastener being mounted to the back side for coupling the strap to the back side.

14. A bulletproof shield assembly comprising:

a panel having a front side and a back side, the panel having a first pair of lateral edges and a second pair of lateral edges, the second pair of lateral edges being attached to and extending between the first pair of lateral edges, each of the second pair of lateral edges having a length exceeding a length of the first pair of lateral edges, each of the first pair of lateral edges having a length between 15.0 inches and 17.0 inches, each of the second pair of lateral edges having a length between 19.0 inches and 21.0 inches;

wherein the front side is convexly arcuate between a first one of the first pair of lateral edges and a second one of the first pair of lateral edges;

the front side comprising a raw carbon fiber material being bonded with an epoxy resin;

the back side comprising an extended chain polyethylene fiber material being blended with the raw carbon fiber material and the epoxy resin, wherein the raw carbon fiber material bonds with the epoxy resin;

a bullet resistant material being coupled to and positioned between the front side and the back side, the bullet resistant material comprising at least four layers of an ultra-high-molecular-weight-polyethylene material, the at least four layers of the ultra-high-molecular-weight-polyethylene material alternating between a heat pressed sheet and a loose sheet of the ultra-high-molecular-weight-polyethylene material;

wherein the extended chain polyethylene fiber material is configured to entangle a projectile being shot at the front side of the panel thereby reducing a force of an impact of the projectile and facilitating the bullet resistant material in stopping a progression of the projectile through the panel;

wherein the raw carbon fiber material is configured to exert a force toward the projectile thereby inhibiting the progression of the projectile through the panel;

a vinyl coating being positioned on the front side;

a decorative indicia being printed on the vinyl coating;

a handle being coupled to the back side, the handle being aligned with the first pair of lateral edges, the handle being positioned proximate to the first one of the first pair of lateral edges, the handle being configured for gripping by a user;

a strap being coupled to the back side, the strap having an extendable length, the strap being configured to receive a shoulder of the user thereby facilitating the user in carrying the panel over the shoulder;

a fastener being mounted to the back side for coupling the strap to the back side, the fastener being spaced from the handle, the fastener being positioned proximate to the second one of the first pair of lateral edges whereby the strap is configured to facilitate the user in gripping the handle while the user is carrying the panel over the shoulder; and wherein the panel has a weight between 4.5 pounds and 7.5 pounds.

15. A method of manufacturing a shield, the method comprising:

providing a raw carbon fiber material;

using the raw carbon fiber material to form a first panel;

providing a blended fiber material comprising an extended chain polyethylene fiber material and the raw carbon fiber material;

bonding an epoxy resin to the blended fiber material to form a bonded fiber material, wherein the epoxy resin bonds with the raw carbon fiber material within the blended fiber material;

using the bonded fiber material to form a second panel, the second panel having a shape being complementary to a shape of the first panel;

providing at least four sheets of a bullet proof material, the bullet proof material comprising an ultra-high-molecular-weight-polyethylene material;

positioning the at least four sheets of the bullet proof material between the first panel and the second panel;

coupling the first panel, the at least four sheets of the bullet proof material, and the second panel together to form a shield having a weight between 4.5 pounds and 7.5 pounds, wherein the first panel comprises a front side of the shield and the second panel comprises a back side of the shield, the shield comprising a first pair of lateral edges and a second pair of lateral edges, the second pair of lateral edges being attached to and extending between the first pair of lateral edges, the second pair of lateral edges having a length exceeding a length of the first pair of lateral edges;

wrapping the shield in a vinyl material;

coupling a handle to the back side of the shield, the handle being aligned with the first pair of lateral edges, the handle being positioned proximate to a first one of the first pair of lateral edges, the handle being configured for gripping by a user;

coupling a fastener to the back side of the shield, the fastener being spaced from the handle, the fastener being positioned proximate to a second one of the first pair of lateral edges; and coupling a strap to the fastener on the back side of the shield, the strap being spaced from the handle wherein the handle is configured for gripping by a user while the strap is positioned around a shoulder of the user.

* * * * *